United States Patent [19]

Pellegrino

[11] Patent Number: 4,989,828

[45] Date of Patent: Feb. 5, 1991

[54] BALL LOCK CONTROL VALVE ACTUATION PLUNGER-MECHANICAL TYPE

[75] Inventor: Joseph C. Pellegrino, Baldwin, N.Y.

[73] Assignee: Grumman Aerospace Corporation, Bethpage, N.Y.

[21] Appl. No.: 556,991

[22] Filed: Jul. 25, 1990

[51] Int. Cl.[5] ..... F15B 13/01

[52] U.S. Cl. ..... 251/58; 91/43

[58] Field of Search ..... 91/393, 43; 251/58, 251/297

[56] References Cited

U.S. PATENT DOCUMENTS 4,784,037 11/1988 Fabyan et al. ..... 91/43

*Primary Examiner*—Gerald A. Michalsky

*Attorney, Agent, or Firm*—Pollock, VandeSande & Priddy

[57] ABSTRACT

An ancillary mechanically driven ball lock control valve actuation plunger cooperates with a piston for displacing a timer valve plunger. An annular locking plunger is pressurized by fluid at a control port, the sliding motion of the plunger controlling the position of locking balls. As the locking balls change their position, they vary the radial extension of a radial plunger. A first portion of a spring-biased cam maintaining contact with the outward end of the radial plunger. When the radial plunger moves to an extended position, it moves the cam until a second cam portion depresses a timer valve plunger thus changing the timer valve state.

5 Claims, 3 Drawing Sheets

BALL LOCK CONTROL VALVE ACTUATION PLUNGER-MECHANICAL TYPE

RELATED APPLICATION

This application relates to my co-pending U.S. patent application Ser. No. 7,534,950, assigned to a common assignee and filed Jun. 8, 1990. The co-pending application is entitled BALL LOCK CONTROL VALVE ACTUATION PLUNGER—HYDRAULIC TYPE.

FIELD OF THE INVENTION

The present invention relates to control valves, and more particularly to a ball lock actuation plunger for such a valve which is mechanically driven.

BACKGROUND OF THE INVENTION

In hydraulic systems it is often necessary to create a timing sequence so that different operations performed by the hydraulic system are done at prescribed intervals relative to one another. The prior art includes various methods for keying a movable piston to a timing mechanism so that, as the piston is moved to a particular position, a timer valve is actuated thereby sequencing further operation of a hydraulic system. A problem in prior art actuating systems has been the existence of fairly complex mechanisms having numerous components which decrease the reliability of the system.

BRIEF DESCRIPTION OF THE PRESENT INVENTION

The present invention is a mechanically driven ancillary device that actuates a timer valve thereby sequencing further operation of a larger hydraulic system which, in not per se part of the invention.

The present invention employs rather simple and quite reliable components for causing actuation of a timer valve as a hydraulic cylinder is driven between two end positions.

The present invention results in an economical and precise means for actuating a timer valve thereby creating reliable sequencing of a main hydraulic system.

BRIEF DESCRIPTION OF THE FIGURES

The above-mentioned objects and advantages of the present invention will be more clearly understood when considered in conjunction with the accompanying drawings, in which:

FIG. 2 is a transverse sectional view taken along a plane passing through section line 2—2 of FIG. 1;

FIG. 2A is a transverse sectional view taken along section line 2A—2A of FIG. 1A.

DETAILED DESCRIPTION OF THE INVENTION

Figure 1:
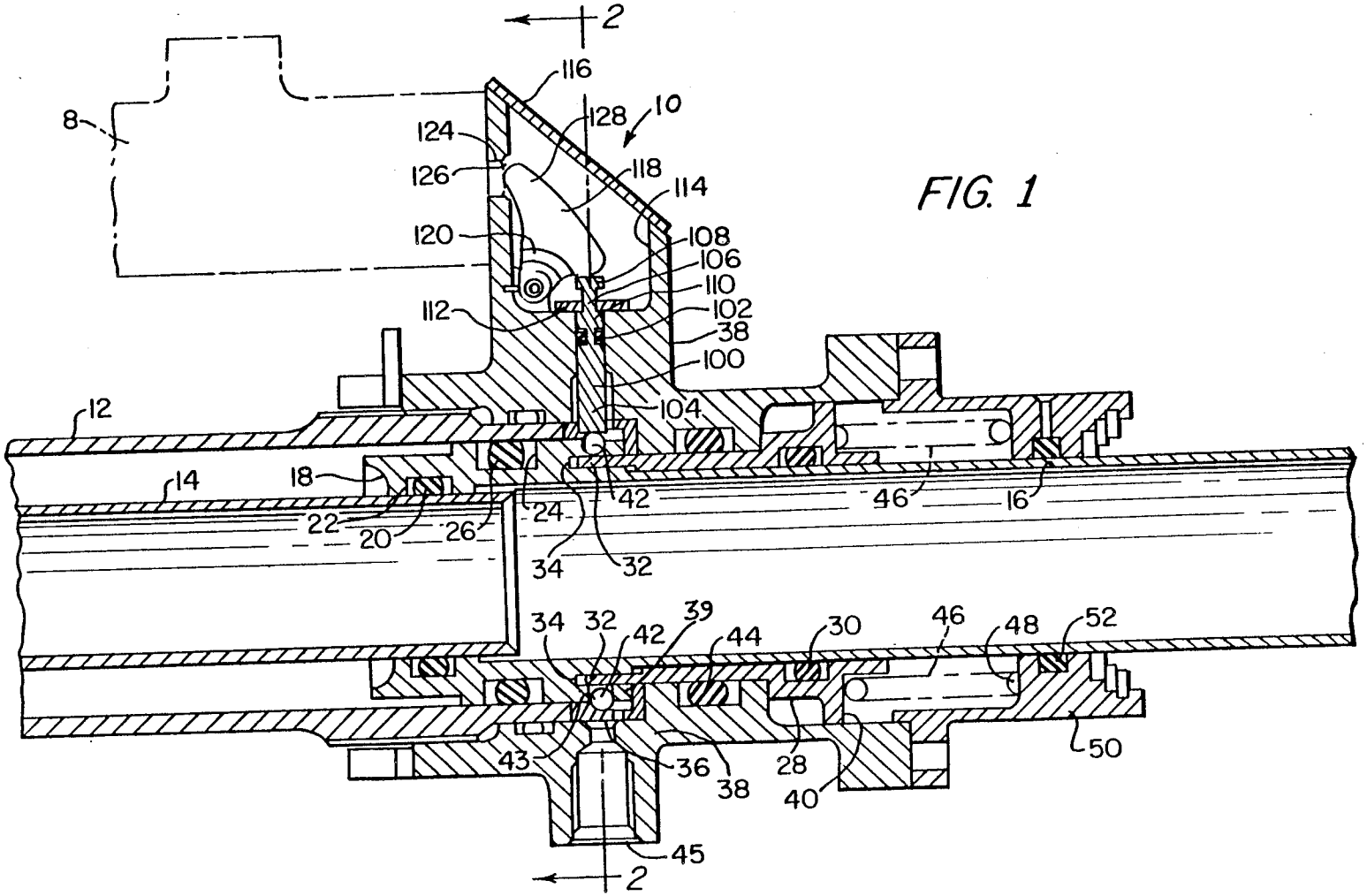
FIG. 1 is a longitudinal sectional view indicating the internal components of the present invention wherein a piston is indicated in a locked position.

A ball lock control valve actuating plunger assembly is generally indicated by reference numeral 10 in the figures. In FIG. 1 the assembly is shown with a main piston 16 in a locked position. The purpose of the assembly is to actuate a timer valve 8 to either port fluid or not port fluid to the hydraulic system in response to the displacement of piston 16 between the locked position shown in FIG. 1 and the unlocked position shown in FIG. 1A.

In order to understand the structure and operation of the present invention, reference is made to FIG. 1 wherein the piston 16 is shown in a locked position (extended) relative to an outer cylinder barrel 12. The interior surface of the piston 16 rides along the exterior surface of a guide tube 14. Piston 16 is moved to the indicated locked position of FIG. 1 by porting a driving pressure along the left-most end of the piston, namely the piston head 18. A groove 22 is formed inwardly from the left end of the piston head 18 so as to receive an O-ring 20 for sealing the interface between the piston head and the guide tube 14. A second groove 24 is formed in the head of the piston 16, at a point further inwardly from the left end of the piston head 18 so as to accommodate an O-ring 26 which creates a seal between the piston head and the cylinder barrel 12. It should be understood that the piston 16 is used to move mechanical members which are not illustrated in the figure and which are not, by themselves, part of the present invention. Rather, the present invention is generalized in terms of indexing timer valve actuation to a hydraulic cylinder displacement.

Figure 1A:
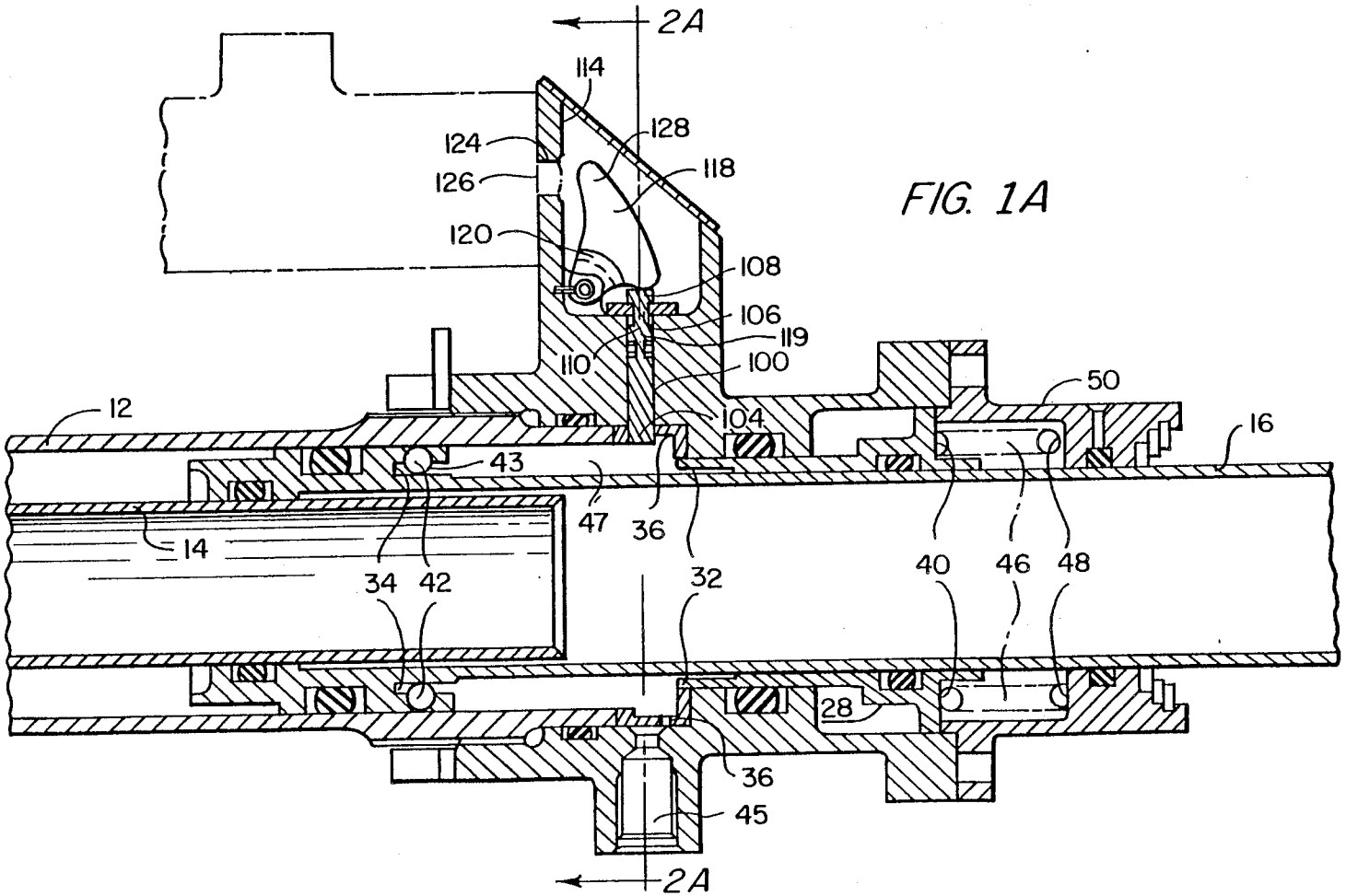
FIG. 1A is a longitudinal sectional view indicating the internal components of the present invention wherein a piston is indicated in an unlocked position.

As is more clearly shown in FIGS. 1A and 2, a number of recesses 43 are formed around the right end of piston head 18 so as to accommodate locking balls 42. A continuous annular recess 34 clearly shown in FIGS. 1 and 1A receives the left end 32 of a generally cylindrical locking plunger 28. The plunger is contained within a housing 38. A cylindrical race 36 is located at radially inward points of the housing 38; and in the locked position of FIG. 1, the locking balls 42 are adapted to rest within the race. As indicated in FIG. 2, a number of locking balls 42 are positioned within the race, at equally spaced points.

In the locked position shown in FIG. 1, the piston head 18 receives hydraulic pressure so that it is displaced to the right until the right protruding edge 39 of the piston head 18 bottoms against the race 36. During the motion of the piston 16 from the left to the right, the locking balls 42 will contact the lock plunger left end 32 thereby driving the lock plunger 28 to the right thereby compressing the coil spring 46 (FIG. 1). The coil spring 46 (FIG. 1) is contained between an annular shoulder 40 of the locking plunger 28 and an oppositely disposed surface 48 of a gland fitting 50. The fitting 50 includes a groove therein to receive a seal 52. Once the right protruding edge 39 of the piston head 18 bottoms against the race 36, the spring 46 which biases the locking plunger 28 in the left direction will force the left end 32 into mating annular recess 34. The presence of the locking plunger 28 against the locking balls 42 causes the balls to be displaced radially outwardly. An O-ring 30 exists between the locking plunger 28 and the rod section of piston 16 while a further O-ring 44 exists between housing 38 and locking plunger 28.

With continued reference to FIG. 1, within housing 38 is a radially positioned plunger 100 having an O-ring 102 positioned along an intermediate point thereof to create a seal for pressurized fluids existing around radially inward points of the plunger. The generally cylindrical intermediate length of the radial plunger extends radially inwardly to an arc-shaped section 104 (FIG. 2) which rests against the locking balls 42. The radially outward end of the plunger 100 has a narrowed neck section 106 existing between a head 108 and shoulder 110. A washer-shaped retainer 112 (FIG. 2) is positioned against a radially inward surface of enlarged recess 114, the retainer 112 is adapted to journal the neck section 106 thereby acting as a mechanical stop and limiting the radially extreme displacements of the plunger 100. The opening of recess 114 is sealed with a cover 116 (FIG. 1) and the opening is large enough to receive a cam 118 therein. The cam has a thick end shoulder 120 seen more clearly in FIG. 2. In that figure a first end of two coil springs 122 is seen connected to the shoulder 120 of the cam while the opposite ends are attached to the recess wall (FIG. 1). The purpose of the springs is to normally bias the cam 118 against the head 108 of radial plunger 100. Accordingly, the inward and outward radial displacement of plunger 100 causes linked movement of the cam 118. An opening 124 is formed in housing 38 so that a plunger 126 of timer valve 8 protrudes therethrough for contact with elongated cam end 128.

In the locked position shown in FIGS. 1 and 2, the radial plunger 100 is contacted by balls 42 thereby urging the radial plunger 100 outwardly. The cam 118 following the plunger 100 then has its end 128 enter opening 124 so as to depress the plunger 126 of the timer valve 8.

When the illustrated mechanism changes to the unlocked position shown in FIGS. 1A and 2A, the cam 128 follows the radial plunger 100 and withdraws from opening 124 so that the plunger 126 of valve 8 may extend fully outwardly thereby changing the state of the valve.

In summary, the present invention offers a reliable mechanically driven ball lock control valve actuation plunger which reliably and cost efficiently permits the change of state of a timer or other control valve so as to sequence further operation of a hydraulic system that would be connected to the timer valve 8.

It should be understood that the invention is not limited to the exact details of construction shown and described herein for obvious modifications will occur to persons skilled in the art.

I claim:

1. A valve actuator comprising:

a piston head having an annular groove transversely formed therein for receiving a plurality of locking balls;

a locking plunger positioned coaxial with the piston head and having an annular end adapted to selectively engage the piston head groove in response to pressure exerted on the head, the annular end contacting the balls thus forcing them radially outward when the plunger end engages the piston groove;

spring means contacting the locking plunger for normally retaining it in a preselected engaged position relative to the piston groove;

radial plunger means radially displaced relative to the piston by the locking balls;

a cam having a first portion retained in contacting relation with the outward end of the radial plunger means;

a port communicating with the piston head annular groove and the locking plunger annular end for causing disengagement between the locking plunger and piston head upon introduction of pressurized fluid into the port which moves the balls radially inward and away from the radial plunger means;

wherein a second portion of the cam contacts a plunger of the valve for moving it from one position to another when the radial plunger means likewise moves from one position to another.

2. The structure set forth in claim 1 wherein the cam is spring biased for retaining contact between the cam and radial plunger means.

3. The structure set forth in claim 2 together with a race transversely located relative to the radial plunger means for receiving locking balls when the piston and locking plunger are engaged.

4. A mechanically driven timer valve actuator comprising:

a piston head having an annular groove transversely formed therein for receiving a plurality of locking balls;

a hollowed cylindrical plunger coaxially positioned over the piston and having an annular end adapted to engage the piston head groove in response to pressure against the piston head;

spring means for normally biasing the annular plunger end into engagement with the piston head groove, the annular plunger end contacting the balls and forcing them radially outward into a race upon engagement of the plunger end with the piston head groove;

generally radial plunger means extending outwardly, relative to the piston, by the locking balls received in the race;

a spring-loaded cam having a first portion retained in contacting relation with the outward end of the radial plunger means;

a port communicating with the piston head annular groove and the locking plunger annular end for causing disengagement between the locking plunger and piston head upon introduction of pressurized fluid into the port which moves the balls radially inward and out from the race thus resulting in loss of contact between the balls and the radial plunger means;

wherein a second portion of the cam contacts a plunger of the valve for moving it from one position to another when the radial plunger means likewise moves from one position to another.

5. The structure set forth in claim 4 wherein the inward end of the radial plunger means includes an arcuate section for contacting a plurality of locking balls when the balls rest in the race.

* * * * *

UNITED STATES PATENT AND TRADEMARK OFFICE

CERTIFICATE OF CORRECTION

PATENT NO. : 4,989,828

DATED : February 5, 1991

INVENTOR(S) : Joseph C. Pellegrino

It is certified that error appears in the above-identified patent and that said Letters Patent is hereby corrected as shown below:

In the drawings, FIGS. 2 and 2A as shown herein should be included with the drawings of the issued patent.

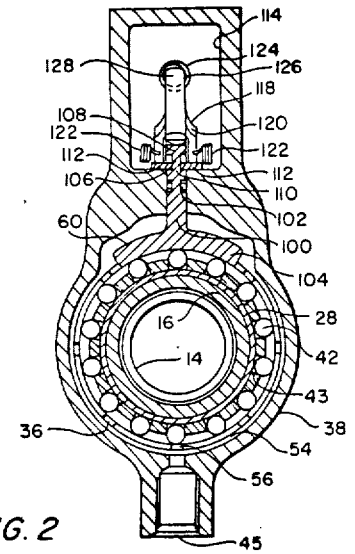

FIG. 2

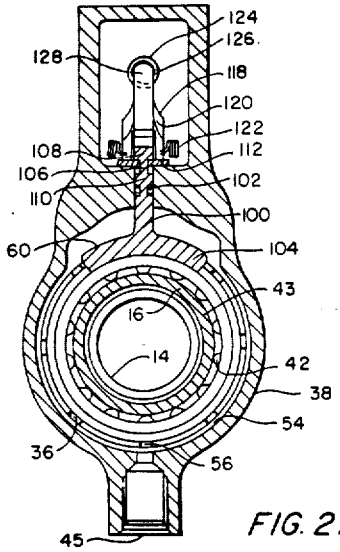

FIG. 2A

Signed and Sealed this

Twenty-fifth Day of August, 1992

*Attest:*

DOUGLAS B. COMER

*Attesting Officer*

*Acting Commissioner of Patents and Trademarks*

UNITED STATES PATENT AND TRADEMARK OFFICE

CERTIFICATE OF CORRECTION

PATENT NO. : 4,989,828

DATED : February 5, 1991

INVENTOR(S) : Joseph C. Pellegrino

It is certified that error appears in the above-identified patent and that said Letters Patent is hereby corrected as shown below:

Column 1, line 35, change "in" to --is--.

Signed and Sealed this

Third Day of November, 1992

*Attest:*

DOUGLAS B. COMER

*Attesting Officer*

*Acting Commissioner of Patents and Trademarks*